United States Patent [19]

Briscoe

[11] Patent Number: 4,791,738

[45] Date of Patent: Dec. 20, 1988

[54] DRAGLINE BUCKET

[75] Inventor: Terry L. Briscoe, Portland, Oreg.

[73] Assignee: ESCO Corporation, Portland, Oreg.

[21] Appl. No.: 65,052

[22] Filed: Jun. 22, 1987

[51] Int. Cl.[4] ..... E02F 3/48

[52] U.S. Cl. ..... 37/116; 37/135

[58] Field of Search ..... 37/115, 135, 116, 117

[56] References Cited

U.S. PATENT DOCUMENTS

| | | | |
|---|---|---|---|
| 963,561 | 7/1910 | Hopkins | 37/135 X |
| 1,050,838 | 1/1913 | King et al. | 37/135 |
| 1,951,909 | 3/1934 | Hayward | 37/135 |
| 2,168,643 | 8/1939 | Berner | 37/135 |
| 2,286,765 | 6/1942 | Settersten | 37/135 |
| 2,525,528 | 10/1950 | Deal | 37/135 |
| 3,112,572 | 12/1963 | Larsen | 37/135 |

*Primary Examiner*—Edgar S. Burr
*Assistant Examiner*—Moshe J. Cohen
*Attorney, Agent, or Firm*—Tilton, Fallon, Lungmus & Chestnut

[57] ABSTRACT

The invention relates to a dragline bucket wherein the center of gravity is along a line making an angle of at least 90° with a line from the tooth tip to the horizontal pivot axis of the dragline hitch. Also disclosed is a movable hitch.

21 Claims, 4 Drawing Sheets

DRAGLINE BUCKET

BACKGROUND AND SUMMARY OF INVENTION

This invention relates to a dragline bucket, viz., a bucket having drag, hoist and dump lines connected thereto and, more particularly, to a bucket having a uniquely located center of gravity which develops heretofore unobtainable advantages in operation.

Although dragline buckets have been used for many years, and many designs employed, no one has focused on the importance of proper location of the center of gravity of the bucket. The only U.S. patent uncovered which mentions center of gravity is Berner U.S. Pat. No. 2,168,643—but this only in connection with the location of a special latch for the hoist line (page 3, line 10).

I have discovered certain relationships in dragline bucket construction that avoid the disadvantages of the prior art buckets. One significant drawback of prior art buckets is that when they began to tip, it took less and less pulling force to continue the tipping action. This meant that when tipping started, the operator had to relax the drag force and re-start the cut. Another drawback was that the prior art designs maximized the dragline force only at the end of a cut, i.e., when the bucket was tilted upwardly. Although this was beneficial at that particular part of the cut, it meant that less than maximum force was applied during the major portion of the cut. The invention not only overcomes these drawbacks but provides other advantages as well.

According to the invention, especially advantageous performance is attained where the bucket has a center of gravity located in relation to certain always-present portions of the bucket, viz., the hitch pivot axis, the tooth tip, and the bucket heel. More particularly, the center of gravity is located along a line making an angle of at least 90° with a line from the tooth tip to the horizontal pivot axis, along a line making an angle of from about 25° to about 30° with a line from the tooth tip to the heel, and so located that from about 50% to about 60% of the bucket weight is on the heel in a static or non-working condition.

Another advantageous feature of the invention is a movable hitch for the drag lines. Locatable hitches have been tried for many years—see U.S. Pat. Nos. 963,561, 1,050,838, 1,951,909, 2,286,765 and 2,525,528—but none have worked out, there being no bucket commercially available for at least the last 30 years which was equipped with a movable hitch. The novel construction of the inventive movable hitch makes it useful, not only in conjunction with the above-described inventive bucket, but other buckets as well.

The invention is explained in conjunction with the accompanying drawing, in which—

DETAILED DESCRIPTION

Figure 1:
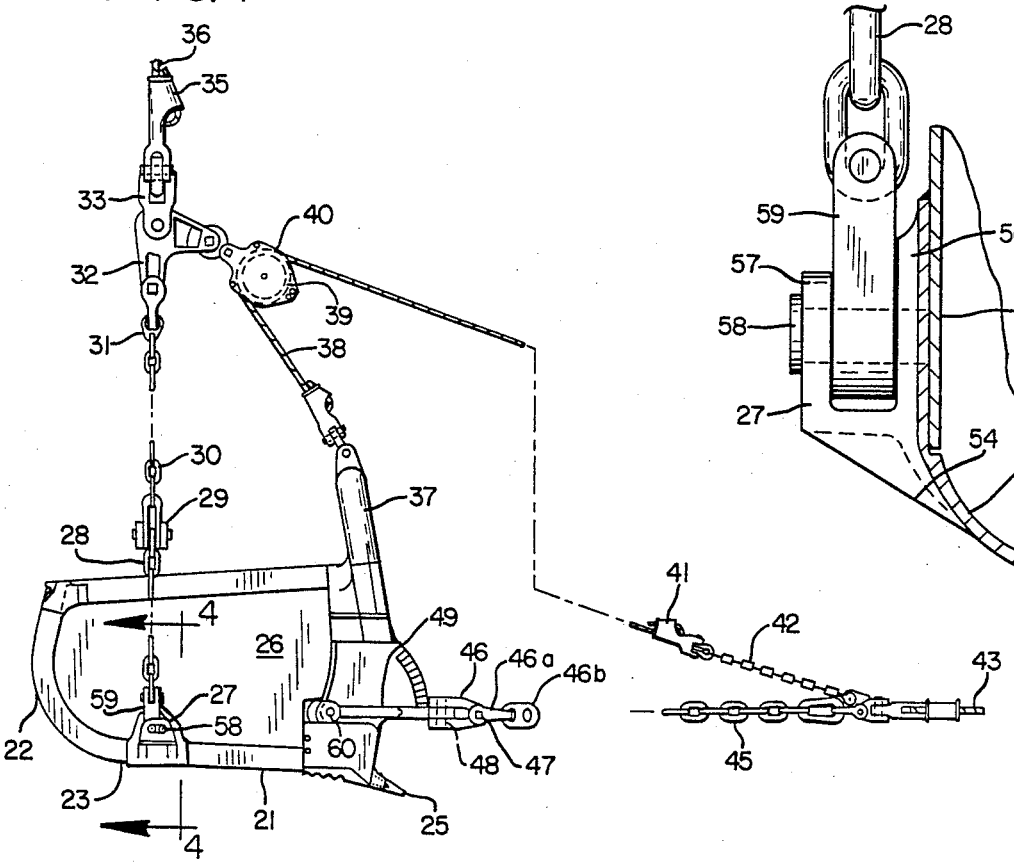
FIG. 1 is a side elevational view of the inventive bucket with associated rigging depicted fragmentarily.
Figure 3:
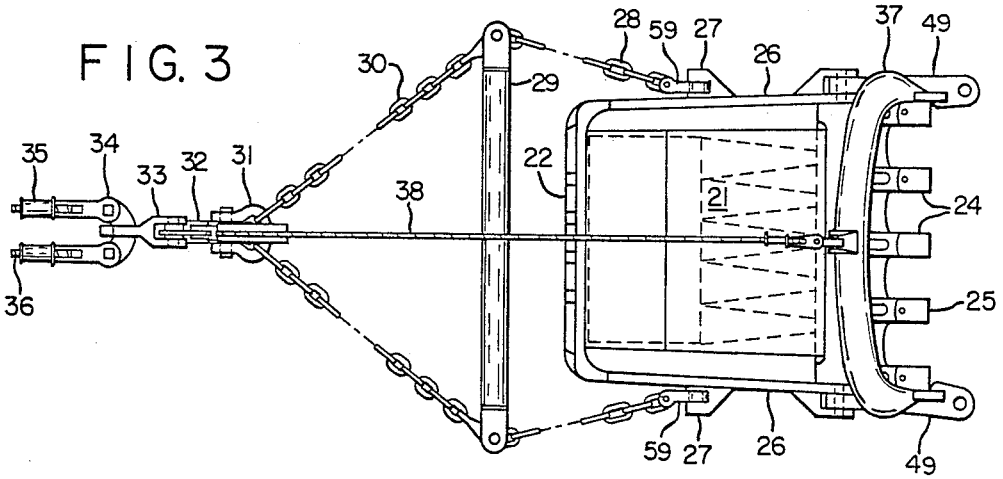
FIG. 3 is a top plan view of the bucket of FIG. 1 but with the upper rigging pivoted rearwardly for ease of showing.

FIG. 1 illustrates generally the inventive dragline bucket. The bucket 20 includes a bottom wall 21 (see also FIG. 4) merging into a rear wall 22 and providing the heel as at 23. The function of the heel 23 can be seen in FIG. 5. The extreme forward portion of the bottom wall 21 is equipped with a plurality of excavating teeth 24 (see also FIG. 3) each of which terminates in a tooth tip 25. As can be seen in FIG. 3, the plurality of teeth 24 have their tips 25 transversely aligned relative to the bucket 20.

The bucket 20 also includes a pair of upstanding sidewalls 26 (compare FIGS. 3 and 4) with the sidewalls being connected to the bottom wall 21 and the rear wall 22. The bucket 20 is symmetrical about a longitudinal center line and each sidewall 26 is equipped with a trunnion 27 for connection to the rigging (see particularly FIG. 4).

The rigging is conventional and many variations can be made to that illustrated depending upon the size of the bucket, type of work, and preference of the bucket designer. Conventionally, however, the rigging includes hoist chains 28 extending upwardly from the trunnions 27 (see FIG. 3) which are connected to a spreader bar 29. The hoist chains continue further upwardly as at 30 to a hoist shackle 31. The hoist shackle 31 in turn, is connected to a swivel link 32 to which is connected the hoist link 33. The hoist link 33 in turn is connected to a hoist equalizer 34 (see particularly FIG.

3) to which a pair of hoist sockets 35 are connected and which, in turn, each receive a hoist rope 36.

The forward ends of the sidewalls 26 are connected by an arch 37 which in turn has connected thereto a dump rope 38. The dump rope 38 is entrained around a pulley 39 (see particularly FIG. 1) which is provided as part of a dump block 40 piotally mounted on the swivel link 32. The dump rope 38 is connected to a socket 41 which in turn is connected to a pair of dump chains 42—see particularly FIG. 2. These in turn are connected to the drag ropes 43 via drag links and shackles 44 and sockets **44*a***.

Figure 2:
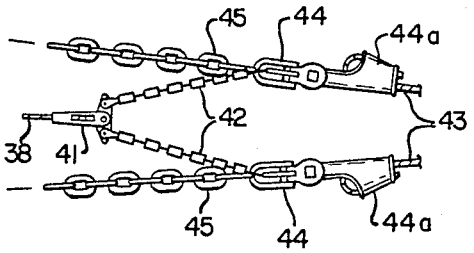
FIG. 2 is a fragmentary top plan view of the rigging illustrated at the right side of FIG. 1.

Proceeding rearwardly, the drag ropes 43 are each secured within sockets **44*a* which in turn are connected to the drag links and shackles 44, and to these the dump chains 42 are attached as well as are the drag chains 45—see particularly FIG. 2. Each drag chain 45 is pivotally connected to shackles 46, 46*a* and link 46*b* to provide a hitch pivot axis as at 47. In the illustration given, the shackles 46 are pivotally pinned as at 48 to movable hitch arms 49**—the construction and operation of which will be described later on.

The rigging just described is operated in conventional fashion to perform the functions of dragging/loading, hoisting and dumping. However, because of the construction of the bucket, particularly the location of the center of gravity, certain novel functions and advantages accrue. A significant advantage is the resistance to tipping which will now be described.

The Pull to Tip Relationship

Figure 6:
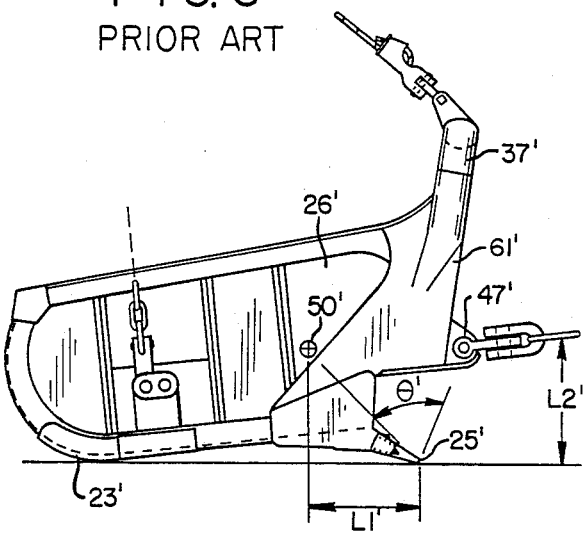
FIG. 6 PRIOR ART
FIG. 6 is a view similar to FIG. 5 but of a typical prior art bucket.
Figure 8:
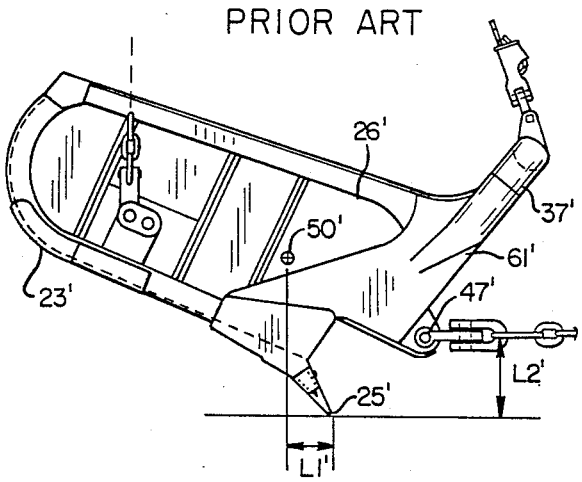
FIG. 8 PRIOR ART
FIG. 8 is a view similar to FIG. 7 but of the prior art bucket.

Reference is now made to FIGS. 6 and 8 which represent a typical prior art bucket in two attitudes. In FIG. 6, the bucket is beginning the cut while in FIG. 8, the bucket is tipped. Two lever arms are involved. The arm L2′ is the perpendicular or vertical distances between the hitch point or pivot axis 47′ and the ground G. The lever arm L1′ is the horizontal distance between the tooth tip 25′ and the center of gravity 50′. Briefly, when tipping started in the prior art bucket, it continued because the lever arm L1′ decreased more rapidly than the arm L2′ (compare FIGS. 6 and 8). When L1′ went to zero, the bucket was completely unstable and tipped over. Thus, operators had to be ever watchful of the tendency to tip and relax the drag ropes 43. This was wasteful of time—it being appreciated that buckets are expensive to operate.

Figure 9:
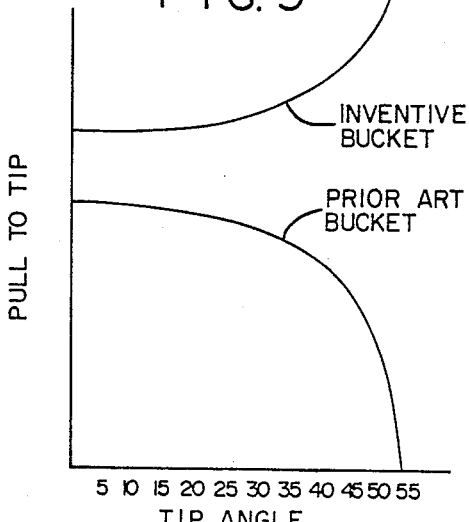
FIG. 9 is a chart relating force necessary to pull both the prior art and inventive buckets to a tipping condition.

The tendency to tip is presented graphically in the lower curve of FIG. 9. As the tipping angle increases, less and less force is required to continue tipping—until the tip angle reached about 50°-55° in the prior art bucket—when it became completely unstable. The lower curve represents the force required to tip a typical prior art bucket where the angle Θ′—see FIG. 6—was 84.5°.

This drawback was tolerated in the prior art buckets because it was felt essential to have as much weight as possible on the teeth—to develop the cut. Therefore the center of gravity—was located as far forwardly as possible. But the weight of the bucket—represented by the center of gravity—is not the only force tending to drive the teeth into the ground. There is also the pull force exerted by the drag ropes. The magnitude of this—in foot-lbs.—is the force in lbs. multiplied by the lever arm L2′. This is counteracted by the force developed by the weight of the bucket in lbs. multiplied by the lever arm L1′. As the drag force increases, the heel 23′ of the bucket is raised, reducing the lever arm L1′. Although this increases the penetrating force, it increases the instability of the bucket through tipping.

Figure 5:
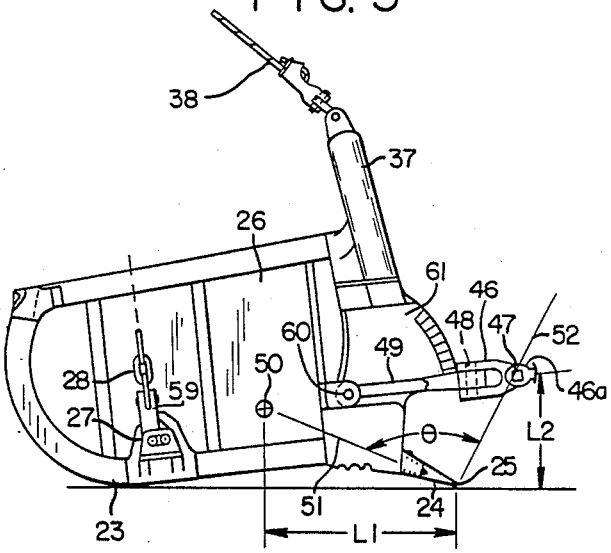
FIG. 5 is a side elevation al view similar to FIG. 1 but with certain dimension lines and angles applied thereto for explanation of the invention.
Figure 7:
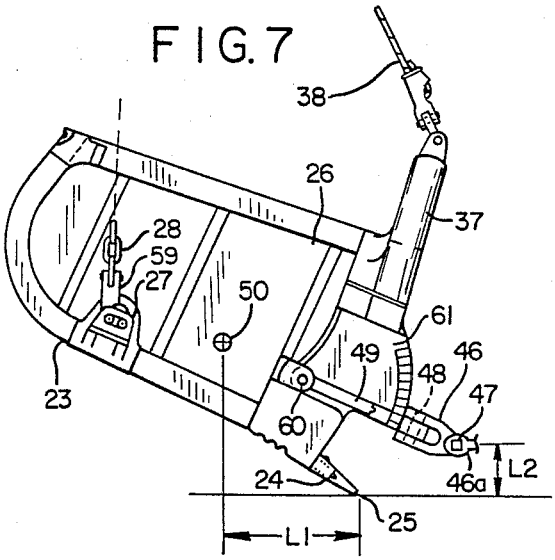
FIG. 7 is a side elevational view of the inventive bucket in a forwardly tipped attitude.

The invention avoids this by locating the center of gravity 50—see FIG. 5—such that the angle Θ between lines 51, 52 from the tip 25 (1) to the center of gravity 50 and (2) to the hitch point 47 respectively is at least 90°. Under such circumstances, the lever arm L2 decreases more rapidly than the lever arm L1 so that instability via tipping is avoided—see the showing in FIG. 7. This is represented by the upper curve in FIG. 9 which shows that as the tipping angle increases, i.e., raising of the heel, the force required to continue the tipping rotation increases. It increases in the inventive bucket to infinity at about the same tip angle that it would go to zero in the prior art bucket.

To get maximum performance from a dragline bucket, it should be on the verge of dipping, i.e., the heel 23 being about to leave the ground G. The reason for this is that when a bucket is close to tipping, most of the weight is on its teeth. With this extra weight on its teeth, the penetration into the material is at a maximum. Therefore, the time-to-load and the distance-to-load is at a minimum.

In operation, the force exerted by the weight of the bucket on the teeth becomes less significant as the cut gets deeper. As the cut deepens, tee force exerted by the pull on the draglines multiplied by the lever arm L2′ creates the more important engagement force on the teeth. But it will be seen that any attempt to increase this penetration force once the heel has left the ground sends the bucket into an increasingly unstable condition. So bucket operators had to be very careful to stay below the hell disengagement situation. This is completely avoided in the inventive bucket.

Figure 11:
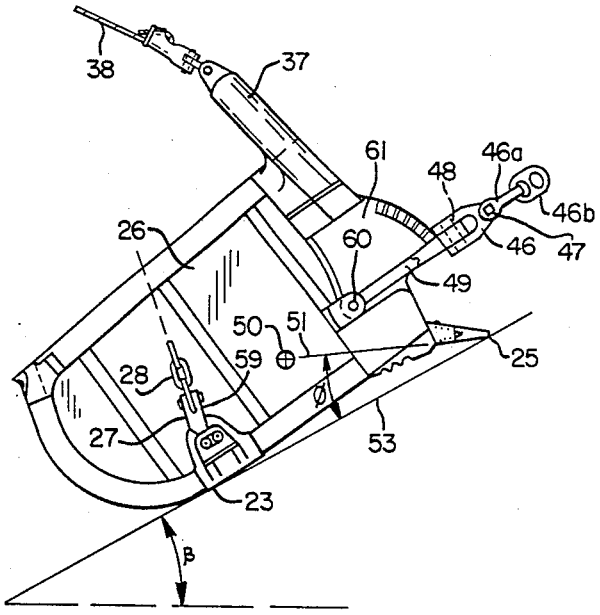
FIG. 11 is a side elevational view of the inventive bucket—again, essentially similar to that of FIG. 1—but operating against an incline to illustrate further the practice of the invention.

Another parameter I have discovered for the location of the center of gravity 50 in the inventive bucket has to do with the angle $\phi$ between the line 51 from the tooth tip 25 to the center of gravity 50 and the line 53 from the tooth tip to the heel 23 of the bucket—see FIG. 11. For optimum performance this angle should be in the range of about 25° to about 30°. However, it is related to the angle Θ previously described between the lines 51 and 52, viz., the lines from the tooth tip 25 to the center of gravity 50 and to the hitch pivot point 47. As the angle Θ becomes larger, viz., somewhat greater than 90°, the optimum angle $\phi$—see FIG. 11—can become somewhat greater than 30°.

Angle Relating Tooth Tip with Center of Gravity and Bucket Heel

In the typical prior art bucket, the angle Φ′ between the lines 51′ and 53′ is of the order of 45°. The line 51′ connects the tooth tip 25′ with the center of gravity 50′ and the line 53′ connects the tooth tip 25′ with the heel 23′—see FIG. 12. The corresponding angle for the inventive bucket is designated in FIG. 11 between the lines 51 and 53 again, connecting, respectively, the tooth tip 25 with the center of gravity 50 and the heel 23.

The center of gravity 50 advantageously is located along or somewhat below the line 51 and its position in the fore and aft direction is dependant upon the severity of the application. For a lightweight bucket or easier digging, the more rearward the center of gravity 50 can be and, correspondingly, the more difficult the digging, the heavier the lip that is going to be needed, viz., the heavier the front end of the bucket, then the center of gravity is advantageously located further forward.

Here it will be appreciated that there is a relatively small zone in which the center of gravity is locatable because of the requirements of basic design—the various walls and arch of the bucket itself.

Figure 12:
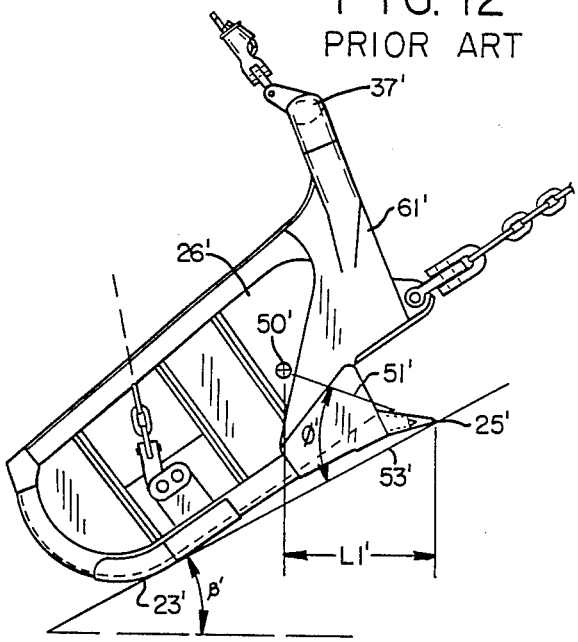
FIG. 12 PRIOR ART
FIG. 12 is a view similar to FIG. 11 but of the prior art bucket.

The importance of the angle Φ (or Φ'—see FIG. 12) can be appreciated by considering the length of the lever arms L1' in FIGS. 6 and 12. In the typical prior art bucket, the lever arm L1' increased as the digging slope increased and the maximum length was attained when the angle Φ' equalled the angle slope β'—see FIG. 12. When the lever arm L1' is a maximum, pull to tip is maximum and the bucket will potentially dig the best. However, the angle β' is equal to Φ' only at the steepest part of the cut. In other words, the best performance only occurred during deeper, steeper digging and therefore during the remainder of the cut, performance was sacrificed from ground level all the way down to the maximum depth.

Mathematically, the variation of the effective component of the lever arm is a cosine function. More particularly, it is a function of the difference between the angles Φ' and β'. In the prior art bucket, the angle Φ' was usually 45°. But at ground level—FIG. 6—the angle β' was zero. So the lever arm L1' was determined by the cosine of 45°, or 0.707 of maximum. The maximum is reached at the cosine of zero, or when Φ' equals β', i.e., a digging slope of 45°. So, in the prior art bucket, the lever arm component started at 0.707 when level and increased to 1.0 at 45°. This is graphically presented in the lower curve of FIG. 10.

According to the invention, the angle Φ—see FIG. 11—is set generally at 30° or less. This develops more effective digging. This stems from the fact that the horizontal component of the lever arm, viz., L1, starts at the cosine of 30° which is 0.866 at ground level (FIG. 5), and reaches a maximum of 1.0 at a 30° slope. It is to be noted, however, that by setting the angle Φ at 30°. there is a substantial improvement in digging efficiency at the beginning of the cut, viz., at ground level. This is because the cosine functions yield effective lever arms of 0.866 as against 0.707—about 22% more. This is graphically presented by the upper curve in FIG. 10.

Figure 10:
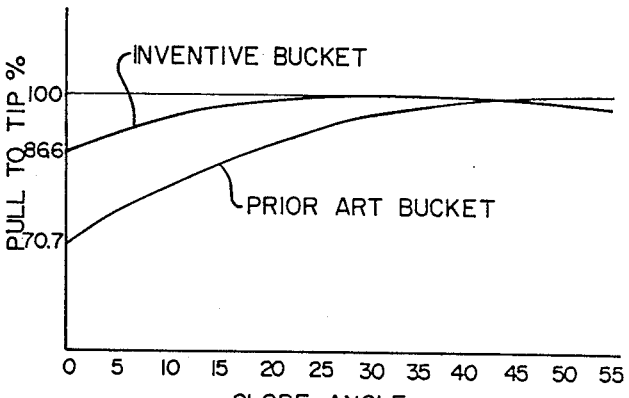
FIG. 10 is a chart relating the pull to tip force percentage vs. slope angle.

The graph of FIG. 10 which illustrates the pull to tip as a function of slope angle represents, in effect, the length of the lever arm L1 with respect to the total length of the arm between the tooth tip 24 and the bucket center of gravity 50 or 50'. The length of this lever arm is exactly proportional to the pull to tip of the bucket. It is significant to note that after the slope angle β (see FIG. 11) is equal to the included angle Φ then the pull to tip is at 1.0 or 100% of maximum. Once the pull to tip has reached a maximum, it stays at the maximum because any further tipping would place the line 51 below the horizontal—and as the bucket tipped, that line would become horizontal.

Weight Distribution Between Tooth and Heel

As mentioned previously, it is possible to design a bucket having a center of gravity so that the angle Φ is greater than 30° provided that the angle Θ is somewhat greater than 90°. Also, as mentioned previously, the center of gravity 50 is confined to a zone because of the basic design considerations inter-relating the bottom wall, back wall, side walls and arch. Historically, the center of gravity has been located in this zone so as to distribute about 55–60% of the bucket weight on the teeth 24. According to the invention, 50–60% of the weight is put on the heel 23.

Heel Wear Metal

This is achieved in a number of ways. One particularly advantageous way is to put more metal in the heel area. This brings about an additional advantage in that more wear can take place before repair is needed. However, even though it is possible to provide more wear metal in the heel, with the inventive bucket being on the verge of tipping, less weight is on the heel. This then counteracts the tendency to wear.

Trunnion

Figure 4:
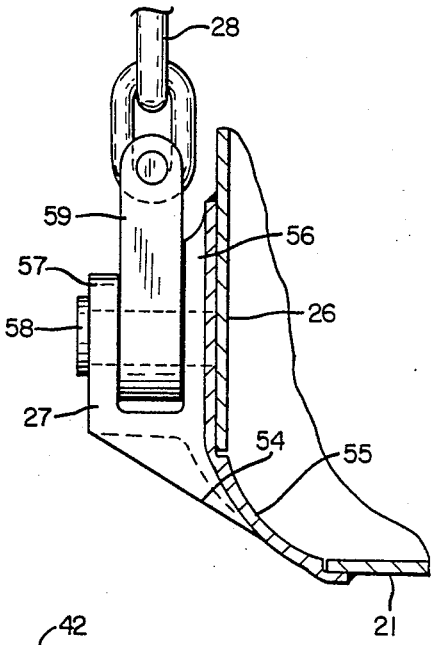
FIG. 4 is an enlarged fragmentary sectional view taken along the sight line 4—4 of FIG. 1.

Another improvement has to do with the trunnion construction which provides an integral corner for improved structural strength and to prevent "oil canning". This results in the provision of more weight rearwardly which assists in the favorable location of the center of gravity. In FIG. 4, the trunnion 27 is seen to be equipped with an elongated arcuate leg 54 portion interconnecting the sidewall 26 with the bottom wall 21. The corner plate 55 is integral with the leg portion 54. This prevents the "oil-canning" characteristic of prior art buckets. Where the trunnion was merely welded to the sidewall, the imposition and relaxation of hoisting forces resulted in flexing of the sidewalls with the possibility of fatigue. The resultant operation is very much like picking up a grocery sack by hands at the bottom rather than pushing in at the sides.

The trunnion above the curved leg 54 is equipped with a pair of upstanding spaced apart portions 56 and 57 which have a pin 58 extending therebetween. This clevis-like arrangement pivotally receives a trunnion link 59 which in turn is connected to the bottom link of the lower hoist chain 28.

Rearwardly Inclined Arch

The invention makes it possible to incline the arch rearwardly as at 37 in FIG. 5 as contrasted to the more conventional forwardly inclined arch 37' of the prior art—see FIG. 6. Although rearwardly extending arches have been known for dragline buckets—see the previously mentioned U.S. Pat. No. 2,168,643—these have not been provided commercially for the last 30 years, at least. Without the need for weight forward on the bucket teeth 24, it is possible to directionally locate the arch to better take the loads from the dump rope. The rearward inclination is selected to be directly at the mid range of dump block movement.

By rearwardly inclined, I refer to the fact that the mid-plane of the arch if extended downwardly would make an acute angle with the bottom wall 21 whereas the prior art forwardly inclined arch makes an obtuse angle with the bottom wall of the bucket.

In addition to providing an advantageous weight distribution according to the invention, the rearwardly inclined arch also affords the opportunity of locating the hitch point higher. The advantages of this will be explained in conjunction with another feature of the invention which has to do with the movable hitch.

Movable Hitch

Figure 13:
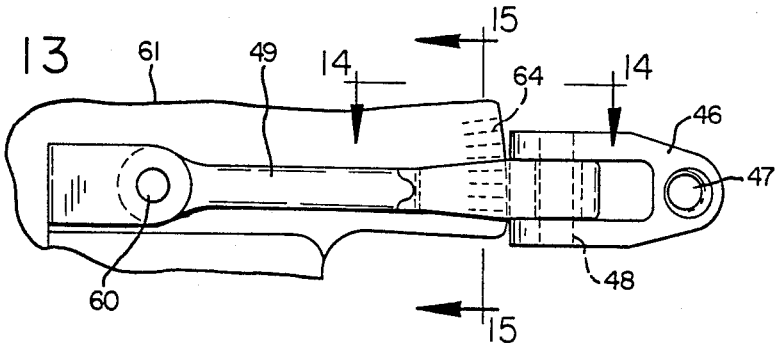
FIG. 13 is an enlarged fragmentary view of the hitch portion of FIG. 1.

The movable hitch arm 49 previously referred to in connection with FIG. 1 is seen in larger scale in FIG. 13. The hitch arm 49 is pivotally mounted as at 60 to a portion of the cheek 61. As can be seen from FIG. 11, for example, the sidewalls 26 at their extreme forward ends are equipped with integral cheeks 61 which rigidity the connection of the arch 37 with the sidewalls 26. The prior art cheek 61' can be seen in FIG. 12 and, again, helps rigidify the connection of the arch 37' with the sidewalls 26'.

Figure 14:
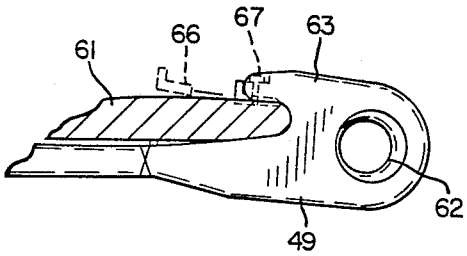
FIG. 14 is a fragmentary sectional view taken along the sight line 14—14 of FIG. 13.
Figure 15:
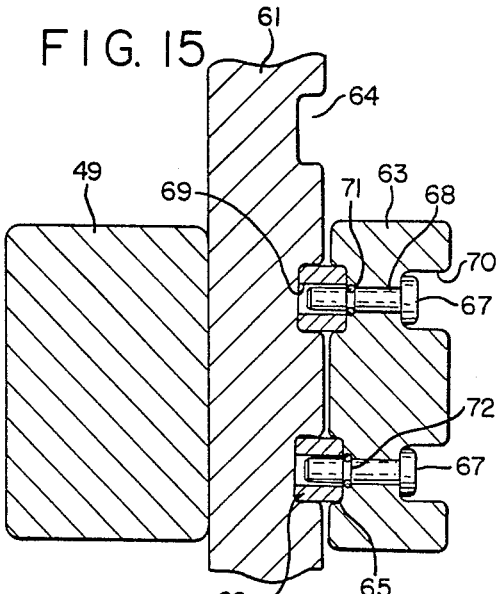
FIG. 15 is another fragmentary sectional view, this time taken along the sight line 15—15 of FIG. 13 and somewhat enlarged relative to FIG. 13.
Figure 16:
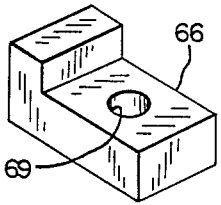
FIG. 16 is a perspective view of the lock member (shear block) shown in dotted line in FIG. 14.

The hitch arm 49—referring to FIG.14—extends forwardly beyond the cheek 61 to provide an opening 62 for the receipt of the pin 48 (see FIG. 11) which connects the hitch shackle 46 to the hitch arm 49. In some cases, it might be advantageous to have the hitch arm free floating or movable through a vertical arc. However, I prefer to immobilize it normally in the position depicted in FIG. 5 which develops the advantageous angle Θ as previously described. For this purpose, the hitch arm 49 is equipped at its forward end with a rearwardly extending arm portion 63 spaced from the main body of the arm 49 and which confronts the inside of the cheek 61. The inside of the cheek 61 is equipped with a plurality of vertically spaced apart, generally horizontally extending slots or recesses 64—see particularly FIG. 15. The integral arm portion 63 is likewise equipped with slots of recesses at 65 which can be aligned with the recesses 64. Once the position of the hitch arm 49 is determined, a locking means in the form of a shear block 66 is inserted into the aligned recesses 64, 65. As can be appreciated from a consideration of FIGS. 14 and 16, the shear block 66 is L-shaped so as to facilitate removal by prying or the like. Additionally, the means for locking the arm in a predetermined position includes pins 67 which extend through generally horizontally extending openings 68 in the arm portion 63 and into an aligned opening 69 in the shear block 66. The arm portion 63 can be advantageously countersunk as at 70 (see FIG. 15) to accommodate the head of the pin 67. Additionally, I provide a snap ring 71 in a circumferential groove 72 (still referring to FIG. 15) in the pin 67 so as to releasably maintain the pin 67 in place.

Figure 17:
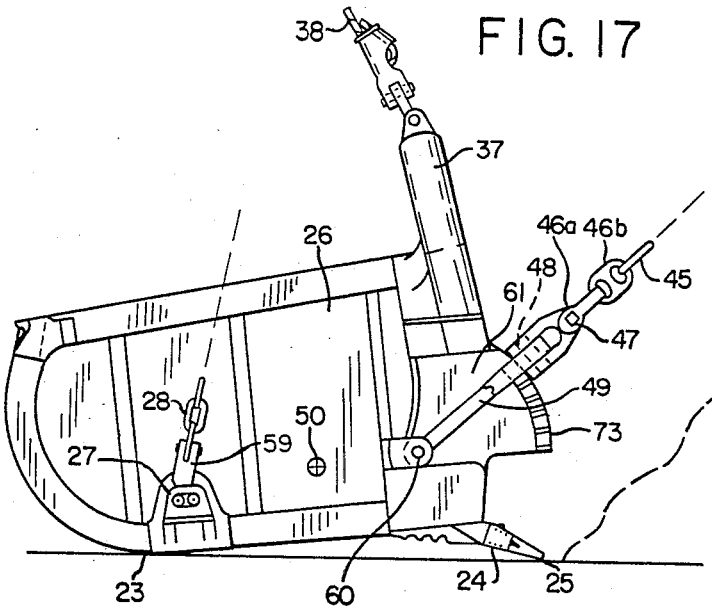
FIG. 17 is a side elevational view of the inventive bucket in condition for cleaning horizontally on the bottom of a deep cut.
Figure 18:
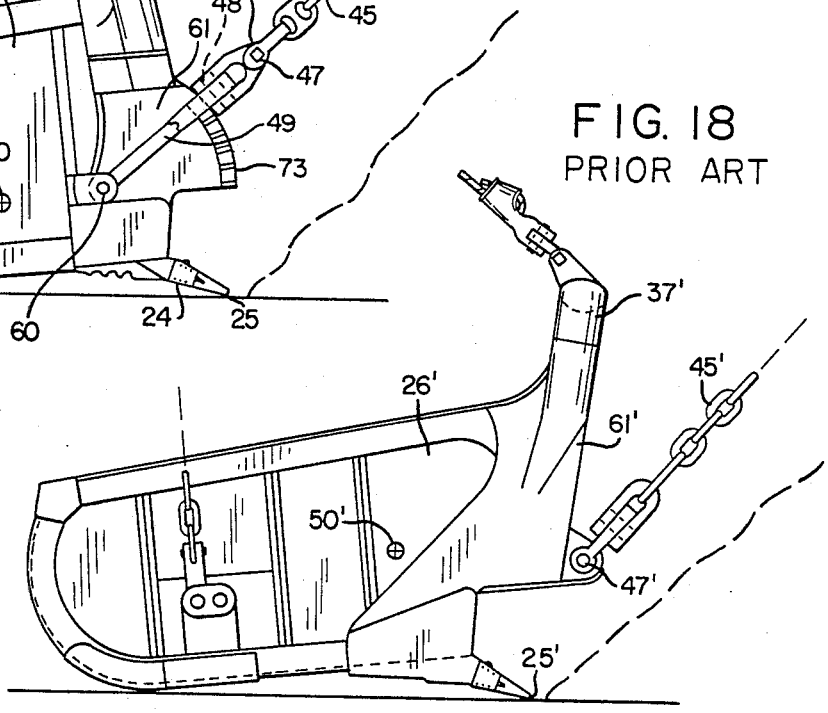
FIG. 18 PRIOR ART
FIG. 18 is a view similar to FIG. 17 but of the prior art bucket.
Figure 19:
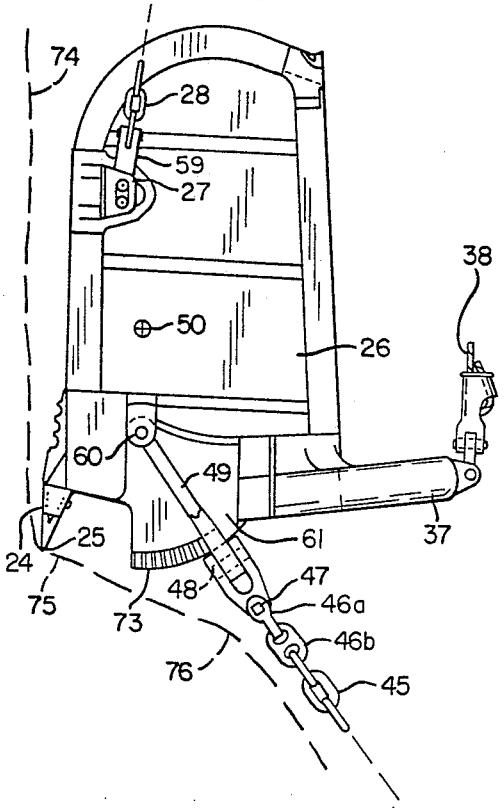
FIG. 19 is a side elevational view of the inventive bucket in condition for chopping.
Figure 20:
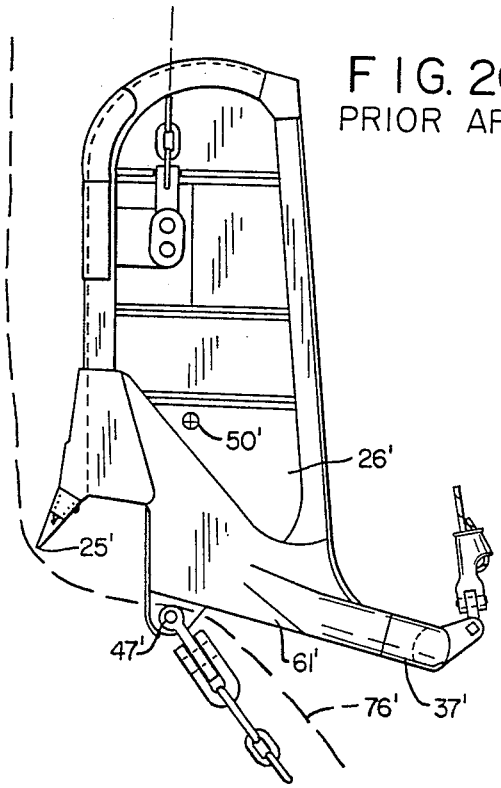
FIG. 20 PRIOR ART
FIG. 20 is a view similar to FIG. 19 but of the prior art bucket.

As indicated previously, the normal and preferred position of the hitch arm 49 is that depicted in FIGS. 5 and 11 but, on occasion, it can be rotated upwardly and temporarily fixed in place for special operations such as the "parting" illustrated in FIGS. 17 and 18 or the chopping illustrated in FIGS. 19 and 20.

Parting

At certain times during the cycle of operation of the bucket, the situation arises where the bucket is sitting flat and the slope is right in front of it as depicted in FIG. 18 relative to the prior art bucket. The object is to clean up this material which could be located, for example, on top of the coal which is being sought. In such a case, the pull force onto the prior art bucket is such that it tends to lift up the front of the bucket. This is in contra-distinction to when the bucket starts up the cut, the force will then again be parallel to the bucket but before it starts up the cut, the pull force is extending very steeply and in such a condition, additional weight on the front end is advantageous in resisting the lifting action. This is achieved by the relocation of the hitch arm 49 to the upper position as seen in FIG. 17. In such a case, the force exerted by the drag chains 45 extends closer to the center of gravity 50 than the force exerted by the drag chains 45' relative to the center of gravity 50' in FIG. 18.

This type of digging is analogous to what is termed cleaning up the "parting"—where the material is right above the coal and is not really rock or coal but kind of a combination of the two. Because it has that combination, it usually carries a lot of moisture and is very difficult to penetrate. If that is a problem to clean up, the operator can move the hitch into the up position, put a lot more force on the teeth at that relationship and get the bucket to penetrate where the operator would never have been able to get the prior art bucket to penetrate because the hitch could not be raised high enough. Also cooperating in achieving this advantageous arrangement is the provision of the rearwardly extending arch 37 as contrasted to the forwardly extending arch 37'.

Also cooperating in the advantageous reposition of the hitch arm 49 is the arcuate forward edge of the cheek 61. The radius of curvature for developing the arcuate forward edge 73 is the axis of rotation of the arm 49 about the pivot pin 60. In the illustration given, I have shown cheeks with the slots or recesses 64 on both the inside and outside—except where the outside slots have been omitted in FIGS. 13–15 for ease of understanding. This dual provision of the slots 64 is for manufacturing convenience. When the cheeks 61 are cast, the recesses 64 are introduced on both sides so that any given cheek could be located either on the right or left sides of the bucket.

Chopping

Another advantageous use of the movable hitch is when the bucket performs what is called "chopping". This is done by holding the bucket vertically beneath the boom point and chopping down on a high wall as at 74—see FIG. 19. This results in shaving the material off at 75 to extend the high wall downwardly. By locating the hitch arm 49 as illustrated in FIG. 19, it is possible to clear the material 76 being shaved whereas this is not possible relative to the material 76' as illustrated in FIG. 20.

Again, the pivot axis 47 is located such that the pulling force extends closer to the center of gravity 50 than according to the prior art design. This results in providing much more freedom of height of the pivot axis than has been achieved even with a multiple hitch on the front of a prior art dragline bucket. Also, the way the hitch arm is constructed permits either the fixing of the hitch ar at any number of points along the front of the bucket—as provided by the multitude of recesses—or in some situations the hitch can be free floating. For example, when in chopping, the hitch can be pulled all the way out, chopping performed and then as the bucket starts to dig, the hitch floats back again into the normal lower digging position.

While in the foregoing specification, a detailed description of an embodiment of the invention has been set down for the purpose of illustration, many variations in the details hereingiven may be made without departing from the spirit and scope of the invention.

I claim:

1. A bucket having drag, hoist and dump lines connected thereto comprising a unitary body having side, rear and bottom walls, said bottom walls terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located:

(a) along a line connecting said center of gravity and said tip and making an angle of at least 90° with a line between said tip and said horizontal pivot axis, (b) along a line connecting said center of gravity and said tip and making an angle of from about 25° to about 30° with a line between said tip and said heel, and (c) so as to put from about 60% to about 50% of the bucket weight on said heel with the remainder on said tip whereby said bucket has an increasing pull-to-tip characteristic.

2. The bucket of claim 1 in which each of said bucket sidewalls adjacent the forward end thereof is equipped with pin means, a hitch arm pivotally mounted on each of said pin means and extending forwardly beyond said forward end, and drag chain means connected to said hitch arm forwardly of said forward end.

3. The bucket of claim 2 in which each of said sidewalls is equipped with a cheek at the forward end thereof, said cheek being equipped with a generally arcuate forward edge to accommodate pivoting of said hitch arm about said pin means, said hitch arm being positioned externally of said cheek and including an integral arm portion positioned interiorly of said cheek, and means operably associated with said cheek and hitch arm for releasably immobilizing said hitch arm in a predetermined position.

4. The bucket of claim 3 in which said cheek is equipped with recess means at said generally arcuate forward edge, said hitch arm being equipped with recess means confronting said cheek recess means, and shear block means in aligned cheek and hitch arm recess means for releasably immobilizing said hitch arm in a predetermined position.

5. The bucket of claim 1 in which an arch having said sidewalls at the forward ends thereof, said arc being rearwardly inclined.

6. The bucket of claim 1 in which each of said sidewalls is equipped with a trunnion for connection of bucket hoist means, each of said trunnions including a downwardly extending curved extension terminating adjacent the bucket bottom wall.

7. A bucket having drag, hoist and dump lines connected thereto comprising a unitary body having side, rear and bottom walls, said bottom walls terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located along a line connecting said center of gravity and said tip and making an angle of at least 90° with a line between said tip and said horizontal pivot axis to provide a bucket having an increasing pull to tip characteristic and an arch connecting said sidewalls at the forward ends thereof.

8. The bucket of claim 7 in which substantial wear metal is provided in said heel to distribute, in a static condition, more weight on said heel than on said tip.

9. The bucket of claim 7 in which each sidewall is equipped with a trunnion, said trunnion including a vertically elongated member extending downwardly to a point adjacent said bottom wall to reduce sidewall flexure under hoisting forces, said trunnions being located rearwardly of said center of gravity.

10. A bucket having drag, hoist and dump lines connected thereto comprising a unitary body having side, rear and bottom walls, said bottom walls terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located along a line connecting said center of gravity and said tip and making an angle of at least 90° with a line between said tip and said horizontal pivot axis to provide a bucket having an increasing pull to tip characteristic, said hitch including a pair of arms, one for each sidewall pivotally attached thereto forwardly of said center of gravity and adapted to rotate through a vertical arc.

11. The bucket of claim 10 in which means are interposed between said sidewall and the associated hitch arm for releasably fixing said hitch arm in a predetermined position.

12. A bucket having drag, hoist and dump lines connected thereto comprising a unitary body having side, rear and bottom walls, said bottom walls terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a dragline connected to said bucket, said body having a design center of gravity located along a line connecting said center of gravity and said tip and making an angle from about 25° to about 30° with a line between tip and said heel, said center of gravity also being located so as to put from about 50% to about 60% of the bucket weight on said heel with the remainder on said tip.

13. The bucket of claim 12 in which the sidewalls are equipped with a rearwardly inclined, interconnecting arch.

14. The bucket of claim 12 in which a vertically elongated trunnion is provided for each sidewall for connection with bucket hoist means, said trunnion being integrated into the bottom corner of said bucket to substantially eliminate the fatigue of eccentric loading on said side walls.

15. A bucket having drag, hoist and dump lines connected thereto comprising a unitary body having side, rear and bottom walls, said bottom walls terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located along a line connecting said center of gravity and said tip and making an angle from about 25° to about 30° with a line between said tip and said heel, and rearwardly inclined arch means interconnecting said sidewalls adjacent the upper forward ends thereof.

16. The bucket of claim 15 in which the center of gravity is located along a line from said tip making an angle of at least 90° with a line from said tip to said horizontal pivot axis.

17. A bucket having drag, hoist and dump lines connected thereto comprising a unitary body having side, rear and bottom walls, terminating in a forward lip equipped with excavating teeth constituting the bucket tip, said bottom wall adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located along a line connecting said center of gravity and said tip and making an angle from about 25° to about 30° with a line between said tip and said heel, and movable hitch means projecting forwardly of said bucket.

18. The bucket of claim 17 in which said bucket is equipped with a rearwardly extending arch connecting said sidewalls.

19. A bucket having drag, hoist and dump lines connected thereto comprising a unitary body having side, rear and bottom walls, said bottom walls terminating in a forward lip equipped with excavating teeth constituting the bucket tip, said bottom wall a adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located so as to put from about 50% to about 60% of the bucket weight on said heel with the remainder on said tip to provide a bucket with an increasing pull-to-tip characteristic.

20. The bucket of claim 19 in which a rearwardly extending arch interconnects said sidewalls.

21. A bucket having drag, hoist and dump lines connected thereto comprising a unitary body having side, rear and bottom walls, said bottom walls terminating in a forward lip equipped with excavating teeth constituting the bucket tip, said bottom wall a adjacent said rear wall being contoured to form a heel, said tip and heel providing the contact areas for supporting the bucket in a static condition, each of said sidewalls at the forward end thereof being equipped with a hitch providing a horizontal pivot axis for a drag chain connected to said bucket, said body having a design center of gravity located so as to put from about 50% to about 60% of the bucket weight on said heel with the remainder on said tip, said hitch including a pair of arm members pivotally connected to the outer sidewalls and projecting forwardly of said bucket.

* * * * *